US012331615B2

(12) United States Patent
Al Sultan

(10) Patent No.: US 12,331,615 B2
(45) Date of Patent: Jun. 17, 2025

(54) WELLHEAD BACK-PRESSURE VALVE INSERTION

(71) Applicant: Saudi Arabian Oil Company, Dhahran (SA)

(72) Inventor: Hussain A. Al Sultan, AlHasa (SA)

(73) Assignee: Saudi Arabian Oil Company, Dhahran (SA)

( * ) Notice: Subject to any disclaimer, the term of this patent is extended or adjusted under 35 U.S.C. 154(b) by 3 days.

(21) Appl. No.: 18/463,957

(22) Filed: Sep. 8, 2023

(65) Prior Publication Data

US 2025/0084723 A1 Mar. 13, 2025

(51) Int. Cl.
*E21B 34/02* (2006.01)

(52) U.S. Cl.
CPC ..... *E21B 34/02* (2013.01)

(58) Field of Classification Search
CPC ..... E21B 34/02
See application file for complete search history.

(56) References Cited

U.S. PATENT DOCUMENTS 5,320,181 A * 6/1994 Lantier, Sr. ..... F16K 15/063 166/325
11,053,769 B2 7/2021 Craycraft
2011/0214882 A1* 9/2011 Santos ..... E21B 21/10 166/85.4
2012/0024521 A1* 2/2012 Villa ..... E21B 33/068 166/75.11
2012/0220501 A1* 8/2012 Mason ..... C09K 8/40 507/133
2017/0167220 A1* 6/2017 Jaffrey ..... E21B 47/00
2018/0003002 A1* 1/2018 Bowen, Jr. ..... E21B 33/04
2022/0290524 A1* 9/2022 El-Sayed ..... E21B 33/068

FOREIGN PATENT DOCUMENTS

WO WO-2019027448 A1 * 2/2019 ..... E21B 33/038

* cited by examiner

*Primary Examiner* — Giovanna Wright
*Assistant Examiner* — Ronald R Runyan
(74) *Attorney, Agent, or Firm* — Fish & Richardson P.C.

(57) ABSTRACT

An insertion tool assembly includes a lubricator and a tubular adapter. The tubular adapter includes a main body with a central bore therethrough. A top end of the adapter can be attached to the lubricator and the bottom end attached to a crown top of a wellhead. The tubular adapter also includes a kill fluid port disposed through a side-wall of the main body. The insertion tool assembly is configured such that, when the BPV is attached to the distal end of the rod and the bottom end of the tubular adapter is attached to the crown top, the BPV can pass through the tubular adapter and into the wellhead through the crown top as the rod is extended from the lubricator, and a kill fluid injected into the kill fluid port can flow through the crown top into the well.

16 Claims, 5 Drawing Sheets

WELLHEAD BACK-PRESSURE VALVE INSERTION

TECHNICAL FIELD

This disclosure relates to well operations, and in particular to an insertion assembly for placement of a back-pressure valve in a wellhead.

BACKGROUND

In some circumstances it is necessary or desirable to temporarily place a back-pressure valve (BPV) within a tubing hanger, so as to isolate the well from the upper portions of the wellhead and allow the repair or replacement of wellhead components. During such operations, particularly in response to an unexpected well control event such as a pressure surge, it is necessary or desirable to stop the well from having the ability to flow to the wellhead by injecting high density fluid (kill fluid) into the wellbore.

SUMMARY

Certain aspects of the subject matter herein can be implemented as a method. The ninsertion tool assembly for disposing a back-pressure valve (BPV) in a tubing hanger installed in a wellhead of a well. The insertion assembly is configured to isolate pressure from the well when attached to a top-most crown of the wellhead and the BPV configured to, when disposed in the tubing hanger, prevent fluid flow from the well through the wellhead while permitting fluid to be pumped into the well. The insertion tool assembly include a lubricator comprising a rod slidably disposed therein. The rod is configured such that the BPV can be releasably attached to a distal end of the rod. The tubular adapter includes a main body with a top end and a bottom end and a central bore therethrough. The top end is detachably attached to the lubricator and the bottom end is configured to be detachably attached to the crown top of the wellhead. An internal diameter of the central bore is greater than an external diameter of the BPV. The tubular adapter also includes a kill fluid port disposed through a side-wall of the main body. The insertion tool assembly is configured such that, when the BPV is attached to the distal end of the rod and the bottom end of the tubular adapter is attached to the crown top, the BPV can pass through the tubular adapter and into the wellhead through the crown top as the rod is extended from the lubricator, and a kill fluid injected into the kill fluid port flows through the crown top into the well.

Certain aspects of the subject matter herein can be implemented as a method. The method includes attaching, to a crown top of a wellhead of a well, an insertion tool assembly for disposing a back-pressure valve (BPV) in a tubing hanger installed in a wellhead. The insertion tool assembly includes a lubricator comprising a rod slidably disposed therein, with the rod configured such that the BPV can be releasably attached to a distal end of the rod. The assembly also includes a tubular adapter that includes a main body with a top end and a bottom end and a central bore therethrough. The top end is detachably attached to the lubricator and the bottom end is configured to be detachably attached to the crown of the wellhead. An internal diameter of the central bore is greater than an external diameter of the BPV. The tubular adapter also includes a kill fluid port disposed through a side-wall of the main body. The method further includes extending the rod and thereby passing the BPV through the tubular adapter and into the wellhead through the crown top and, in response to a well control event indication, injecting a kill fluid into the kill fluid port, thereby flowing kill fluid through the crown top into the well.

Certain aspects of the subject matter herein can be implemented as a method. The method includes attaching a top end of a tubular adapter to a lubricator. The lubricator includes a rod slidably disposed therein, with the rod configured such that a BPV can be releasably attached to a distal end of the rod. The tubular adapter includes a main body with a top end and a bottom end and with a central bore therethrough and a kill fluid port disposed through a side-wall of the main body. While maintaining a crown top valve of a crown top of a wellhead of a well closed and the rod fully retracted such that the BPV attached to its distal end is within the central bore and above the bottom end, the bottom end of the tubular adapter is attached to the crown top. After attaching the bottom end to the crown top, the crown top valve is opened. After opening the crown top valve, the rod is extended, thereby passing the BPV out the bottom end of the tubular adapter and into the wellhead through the crown top. After the extending, the BPV is retracted from the wellhead with the rod and into the central bore of the tubular adapter above the bottom end and the crown top valve is thereafter closed while the bottom end remains attached to the crown top.

The details of one or more embodiments are set forth in the accompanying drawings and the description below. Other features, objects, and advantages will be apparent from the description and drawings, and from the claims.

DETAILED DESCRIPTION

The present disclosure is directed to operations at a wellhead of a well drilled into a subterranean zone. Particularly, the present disclosure is directed to installation and removal of a back-pressure valve (BPV) within a wellhead.

It is sometimes necessary to temporarily insert and install a back-pressure valve (BPV), a type of check valve, within a central bore of the wellhead (for example, within a tubing hanger) to isolate pressure from the production tubing when valves of a wellhead must be opened or removed or replaced or during other servicing or maintenance operations. Assemblies for such insertion and isolation typically include so called "lubricator" assemblies that include a rod and equalization apparatus to allow the BPV to be inserted through the wellhead to the tubing hanger while maintaining pressure isolation of the wellhead.

During such operations, in response to an indication of an unexpected well control event (such as a kick, pressure surge, or blowout), it can be necessary or desirable to inject a kill fluid (a high-density fluid) into the well to prevent further fluid flow from the well to the wellhead. However, kill fluid line injection ports typically present as part of wellhead assemblies may be blocked or otherwise unavailable, problematic to use, or provide insufficient injection capacity while the insertion assembly is attached to the wellhead. Furthermore, debris on or around a BPV may interfere with BPV installation and with other wellhead operations as the BPV it may in some circumstances or other while maintaining the BPV In accordance with embodiments of the present disclosure, an insertion tool assembly for disposing a back-pressure valve (BPV) in a tubing hanger is provided, that includes, in addition to a lubricator, a separate, detachable tubular adapter that includes its own, separate a kill fluid port, that can be attached to the wellhead crown. The tubular adapter can enable a standard BPV (for example, a seven-inch Type K BPV) to be installed and retrieved using a standard (off-the-shelf) lubricator and the assembly attached to the wellhead, using standard operating procedures, while permitting the crown valve to remain closed as the insertion assembly is attached to and detached from the crown of the wellhead. In the event of a well control event while the crown valve is open, a kill fluid can be injected into the kill fluid port, such that the kill fluid can enter the wellhead through the crown top while the insertion assembly remains attached. The fluid port also provides a pathway through which fluid can be injected to clear debris from on, above, our around the BPV prior to insertion within the wellhead. Wellhead operations can thus be conducted with less expense and less risk to personnel and the environment.

Figure 1:
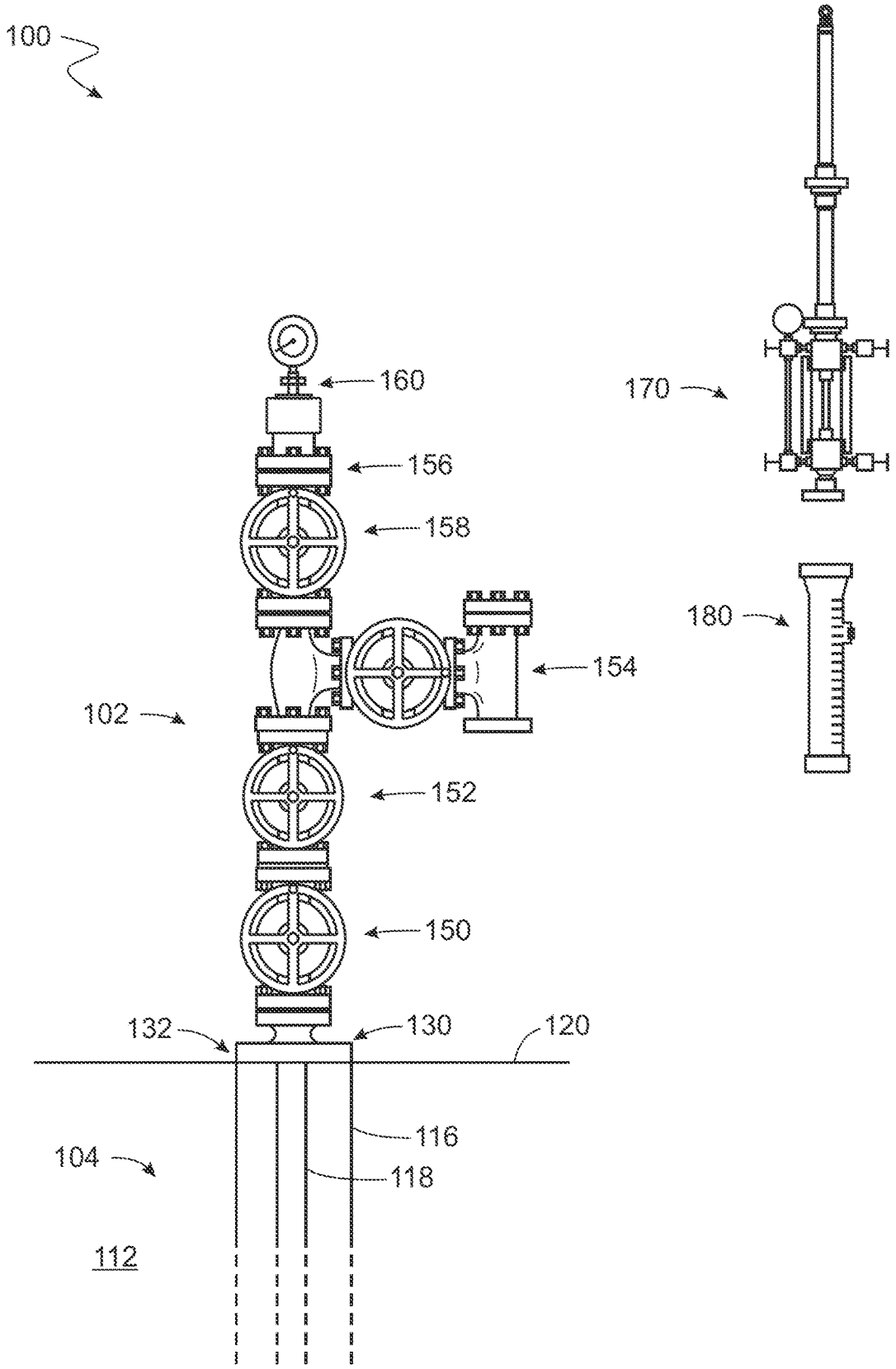
FIG. 1 is a schematic diagram of a well system in accordance with an embodiment of the present disclosure.

FIG. 1 is a schematic diagram of a well system in accordance with an embodiment of the present disclosure. Referring to FIG. 1, well system 100 includes a well 104 drilled into subterranean zone 112 from surface 120. Wellbore fluids (such as gas and oil) can be produced from the subterranean zone or zones through production tubing 118 within casing 116 up to wellhead 102 at the surface end of well 104. Wellhead 102 in the illustrated embodiment comprises a Christmas tree that. Wellhead 102 includes various valves, spools, pressure gauges, chokes, and other wellhead components to monitor, regulate, and control well pressure and the production of the wellbore fluids from well 104. Such wellhead components include includes a tubing hanger 130 from which production tubing 118 is suspended (hung), and casing hanger 132 from which casing 116 is hung. Wellhead 102 further includes lower master valve 150 and upper master valve 152 to control the flow of fluid from the wellbore and production wing 154 from which produced wellbore fluids can be conveyed towards pipelines or other treatment, gathering, or conveyance facilities. Crown 156 is the top-most portion of the wellhead which provides vertical access to the wellbore. Just below crown 156, within the wellhead, is crown valve 158 (i.e., the top-most valve of the wellhead below the crown top, configured to selectively permit or prevent fluid flow vertically through crown 156). Attached above crown 156 is a cap 160. When cap 160 is removed, vertical access is provided to the central bore of the wellhead through crown 156 when necessary for service, repair, and other wellhead operations.

Well system 100 further includes a lubricator 170 and tubular adapter 180, described in further detail below. Lubricator 170 and tubular adapter 180 can together comprise an insertion assembly for inserting a BPV into a tubing hanger within wellhead 102.

Figure 2A:
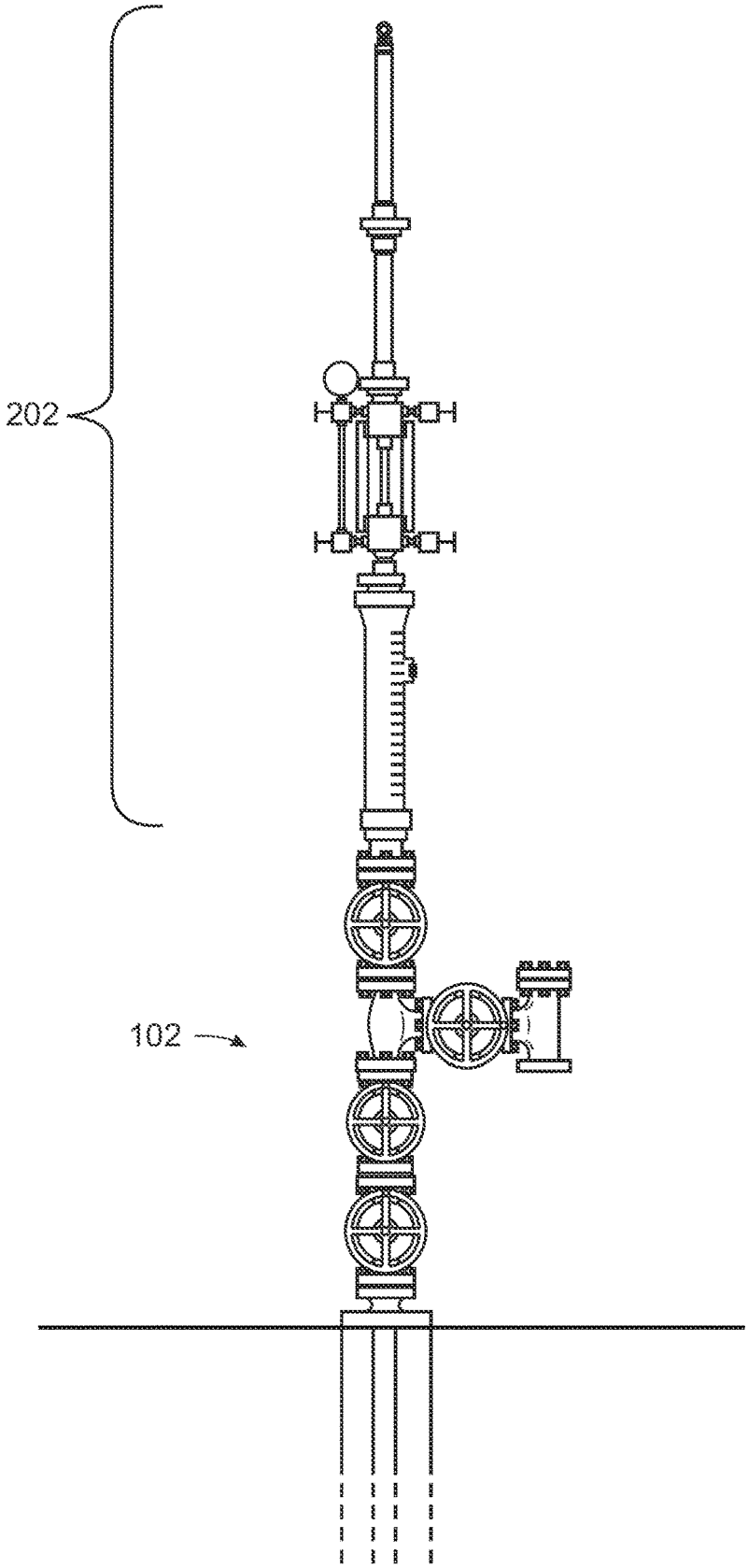
FIGS. 2A-2C are schematic illustrations of a back-pressure valve insertion assembly in accordance with an embodiment of the present disclosure.
Figure 2B:
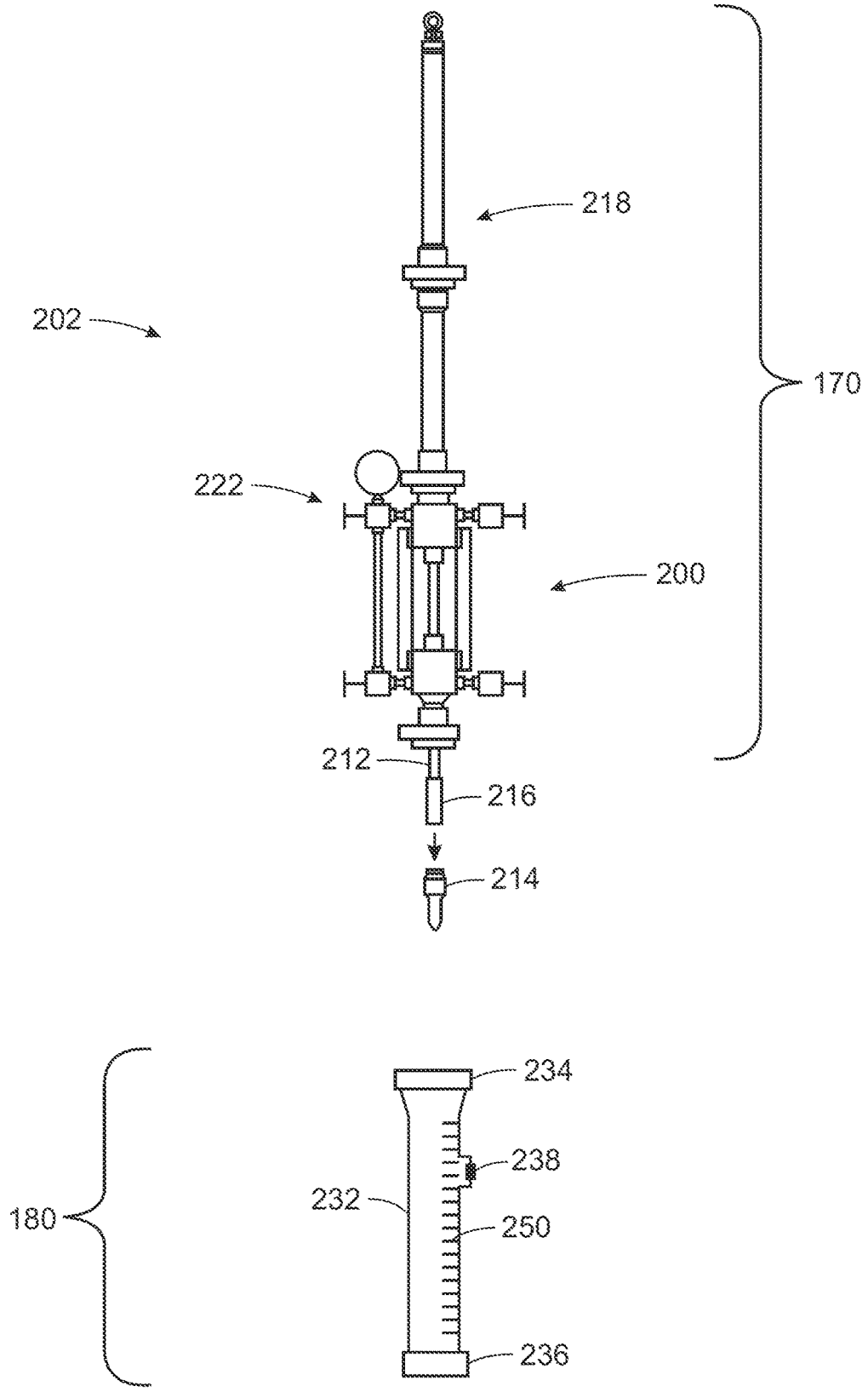
Figure 2C:
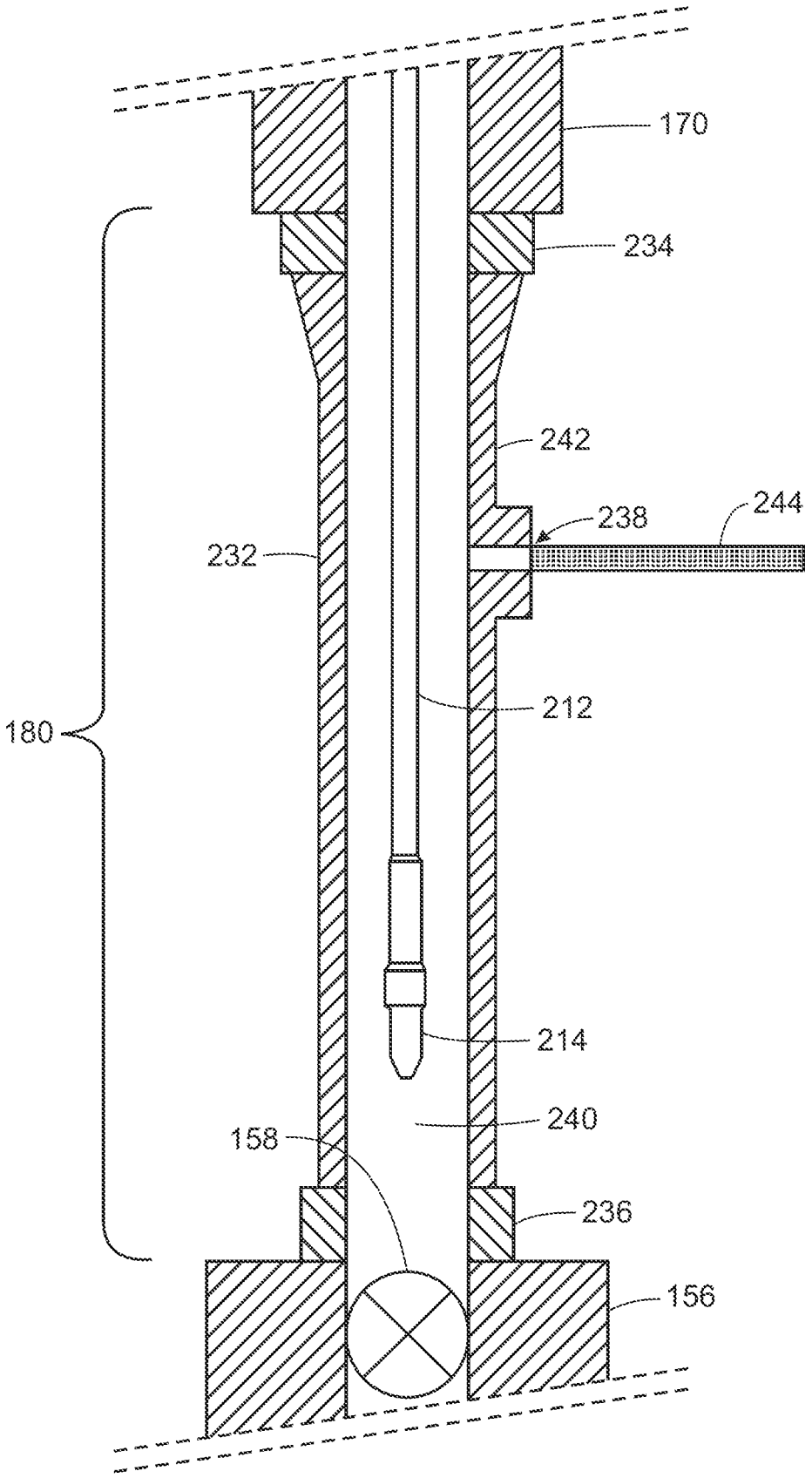

FIGS. 2A-2C are schematic illustrations of an insertion assembly 202 for inserting and installing a BPV into wellhead 102, in accordance with an embodiment of the present disclosure. As shown in FIG. 2A, with cap 160 removed, insertion assembly 202 attached 202 crown 156 of wellhead 102, valves 152, 152, and 158 can be opened while inserting and installing a BPV within the wellhead, while still maintaining pressure isolation of the well.

As shown in FIG. 2B, insertion tool assembly 202 includes lubricator 170 with a rod 212 slidably disposed within. BPV 214 (which can be a Cameron Type H BPV or another suitable BPV) can be attached to distal end 216 of rod 212 prior to attachment of the insertion tool assembly to crown 156, and, with the insertion tool assembly subsequently attached, rod 212 can be extended from assembly 202 into the wellhead and to the tubing hanger or other desired installation point for BPV 214 within the wellbore. BPV 214 can include threads or another suitable releasable coupling to temporarily lock BPV 214 at its installation point in the tubing hanger, thus preventing movement of BPV 214 such that it can serve its pressure isolation function. Distal end 216 can likewise include with a suitable releasable coupling for allowing BPV 214 to be disengaged from rod 212 when installation of BPV 214 at the installation point has been accomplished and to re-engage BPV 214 to distal end 216 for retrieval.

Lubricator 170 includes a barrel 218 (within which rod 212 is enclosed) and yoke 200 to provide access to rod 212 by a wrench or other device to mechanically extend and retract rod 212. Pressure equalizing assembly 222 can equalize pressure above and below yoke 200 when assembly 202 is attached to crown 156, thus permitting the extension and retraction of rod 212 while maintaining pressure isolation above and below yoke 200.

As shown in FIG. 2B (and in cross-section in greater detail in FIG. 2C), tubular adapter 180 includes a main body 232 with a top end 234 and a bottom end 236, and a central bore 240 through the body. Top end 234 is configured to be attached to 170 attached with a threaded coupling or other suitable coupling to allow it to be attached, detached, and re-attached. Bottom end 236 is likewise configured to be releasably attached to the top crown 156 of wellhead 102. The internal diameter of the central bore 240 is greater than an external diameter of BPV 214. So attached to the wellhead. When BPV 214 is attached to the distal end of rod 212 and bottom end of the tubular adapter is attached to crown of the wellhead, insertion assembly 202 isolates pressure from the well even when valves 150, 152, and 158 have been opened and, when rod 212 is extended, BPV 214 passes through central bore 240 and into the wellhead through crown 156 and opened crown valve 158 and master valves 150 and 152 to be positioned and locked into the tubing hanger. With BPV 214 positioned in the tubing hanger, repair and replacement of wellhead components (such as valves 150, 152, 158, or other components) can commence.

In the illustrated embodiment, tubular adapter 180 is of sufficient length such that, wherein when BPV 214 is attached to the distal end 216 of rod 212 and rod 212 is in its fully retracted position, BPV 214 does not extend past the bottom end 236. In this way, tubular adapter 180 provides a shield to protect BPV 214 from impact and/or debris is attached to rod 212 but before In the illustrated embodiment, main body 232 of tubular adapter 180 includes measurement indicators 250 engraved on its outer surface. The measurement indicators provide a visual reference to aid the operator in confirming whether the BPV is fully retracted within the tubular adapter during lubricator attachment and detachment operations and ensure proper positioning of the BPV in relation to tubing hangers and other wellhead components during BPV insertion and removal.

As shown in FIG. 2C, tubular adapter 180 includes a kill fluid port 238 disposed through side-wall 242 of main body 232, to which a kill fluid line 244 can be attached. A kill fluid injected into the kill fluid port 238 will flow into central bore 240 and through top crown 156 and (if crown valve 158 and the valves (such as master valves 150 and 152) are open) into the well. As explained further in respect to FIG. 3, the location and configuration of kill fluid port 238 on insertion assembly 202 enables well kill operations through top crown 156 when insertion assembly 202 is attached to crown 156 and the crown valves and other wellhead valves are open, even if other kill port valves on the wellhead my be blocked or otherwise unavailable for use. In addition, fluid line port 238 provides an entryway into which fluids can be injected to clean debris from, above, and/or under BPV 214, when insertion tool assembly 202 is attached to wellhead 102 and prior to, before or during extension of rod 212. In some embodiments, the fluid injected into the kill fluid port to clean the debris is a fluid type other than a kill fluid (for example, a fluid including surfactants to maximize the debris cleaning effect). In the illustrated embodiment, kill fluid port 238 is positioned above BPV 214 when rod 212 is in the fully retracted position. So configured, the force of fluid flow through kill fluid port 238 can more directly strike debris that may be disposed on the top portion of the BPV 214 and on rod 212 even when rod 212 is fully retracted. Thus, such a configuration can provide an advantage to such debris clearing compared to injection through ports that may be located further down in the wellhead.

Figure 3:
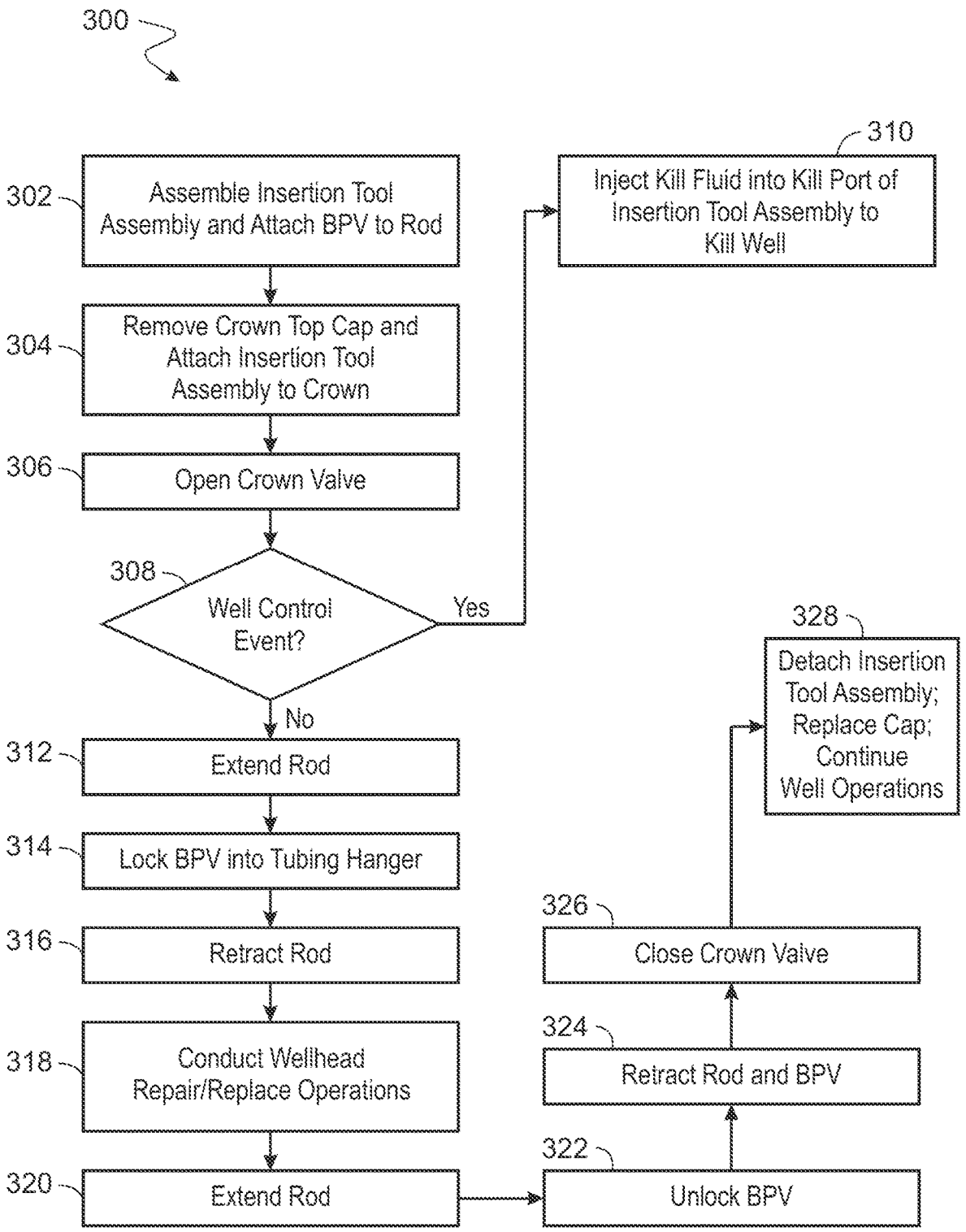
FIG. 3 is a process flow diagram of a method of wellhead operations in accordance with an embodiment of the present disclosure.

FIG. 3 is a process flow diagram of a method 300 of wellhead operations in accordance with an embodiment of the present disclosure. The method begins at step 302 in insertion tool assembly 202 is assembled and BPV 214 is attached to rod 212. At step 304, crown cap 160 is removed from wellhead 102 and insertion tool assembly 202 is attached top crown 156. At step 306, with assembly 202 providing pressure isolation, crown valve 158 and the master valves 150 and 152 are opened, such that BPV insertion operations can commence in preparation for wellhead and repair operations.

Proceeding to step 308, if the operator has an indication of a potential well control event indicating that a well kill operation is necessary or desirable (for example, in the case of a pressure surge or other indication of an unexpected well pressure situation), then the method proceeds to step 310 in which kill fluid is injected into assembly 202 at port 238 such that the fluid flows into the wellhead and the well through crown 156. While these steps are illustrated as occurring after step 306, an operator can initiate such a kill fluid injection operation into assembly 202 at any time while the assembly is connected to wellhead 102. Port 238 in assembly 202 thus provides a removable kill fluid injection apparatus that can operate instead of or in addition to other kill line ports of the wellhead while BPV insertion operations are occurring. Because standard kill line ports within a wellhead can sometimes fail (for example, due to a broken shear pin), or may or the wellhead may have not been designed with sufficient kill ports, kill port 238 can provides important back-up pressure control to enhance operational safety. Furthermore, such kill fluid injection occurs through the top cap of the wellhead rather than through side ports. Thus, kill operations can be readily conducted even if side ports may be inaccessible due to equipment or other barriers that might prevent access to side ports during an emergency situation.

In the absence of a well control indication such that a well kill operation is desired, the method proceeds to step 312 in which rod 212 is extended from assembly 202 so as to move BPV 214 through the wellhead to the tubing hanger and then, at step 314, BPV 214 is locked into the tubing hanger. Rod 212 can then be retracted at step 316, and at step 318, wellhead repair and/or wellhead component replacement operations can be conducted.

After wellhead repair/replacement operations have been completed, the method proceeds to step 420 in which rod 212 is again extended into the wellhead to land on and (at step 422) unlock BPV from the tubing hanger. Then at step 424 rod 212 can be retracted to retrieve BPV 213. When BPV reaches the position above crown valve 158, the crown valve (and also the master valves) can be closed, isolating the wellhead so that, at step 428, assembly 202 can be detached from the wellhead, cap 160 replaced, and well operations continued.

The term "uphole" as used herein means in the direction along a wellbore from its distal end towards the surface and through the wellhead, and "downhole" as used herein means the direction through the wellhead and along the wellbore from the surface towards the wellbore's distal end. A downhole location means a location along a wellbore downhole of the surface.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

As used in this disclosure, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed in this disclosure, and not otherwise defined, is for the purpose of description only and not of limitation. Any use of section headings is intended to aid reading of the document and is not to be interpreted as limiting; information that is relevant to a section heading may occur within or outside of that particular section.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate. Accordingly, the previously described example implementations do not define or constrain the present disclosure. Other changes, substitutions, and alterations are also possible without departing from the spirit and scope of the present disclosure.

Examples

In a first aspect, an insertion tool assembly for disposing a back-pressure valve (BPV) in a tubing hanger installed in a wellhead of a well is provided. The insertion assembly is configured to isolate pressure from the well when attached to a top-most crown of the wellhead and the BPV configured to, when disposed in the tubing hanger, prevent fluid flow from the well through the wellhead while permitting fluid to be pumped into the well. The insertion tool assembly include a lubricator comprising a rod slidably disposed therein. The rod is configured such that the BPV can be releasably attached to a distal end of the rod. The tubular adapter includes a main body with a top end and a bottom end and a central bore therethrough. The top end is detachably attached to the lubricator and the bottom end is configured to be detachably attached to the crown top of the wellhead. An internal diameter of the central bore is greater than an external diameter of the BPV. The tubular adapter also includes a kill fluid port disposed through a side-wall of the main body. The insertion tool assembly is configured such that, when the BPV is attached to the distal end of the rod and the bottom end of the tubular adapter is attached to the crown top, the BPV can pass through the tubular adapter and into the wellhead through the crown top as the rod is extended from the lubricator, and a kill fluid injected into the kill fluid port flows through the crown top into the well.

In second aspect according to the first aspect, the insertion tool assembly is configured such that, when a crown valve of the wellhead is open, the kill fluid flowing into the tubular adapter flows vertically through the crown top into the well through the crown valve.

In a third aspect according to the first aspect or the second aspect, the insertion tool assembly is configured such that, when kill fluid flows through the crown top into the well, all wellhead valves through which the rod can pass when extended are open.

In a fourth aspect according to any of the first aspect to the third aspect, the kill fluid flowing through the crown top into the well flows through the BPV.

In a fifth aspect according to any of the first aspect to the fourth aspect, the BPV, when attached to the distal end and the rod fully retracted, does not extend past the bottom end.

In a sixth aspect according to any of the first aspect to the fifth aspect, the insertion tool assembly is configured such that injection of a fluid into the kill fluid line port from the fluid line dislodges debris within the central bore.

In a seventh aspect according to any of the first aspect to the fifth aspect, the assembly is configured such that the crown top of the wellhead can remain closed as the bottom end is attached to the bottom end and can be opened after attaching the bottom end to the crown top In an eighth aspect, a method includes attaching, to a crown top of a wellhead of a well, an insertion tool assembly for disposing a back-pressure valve (BPV) in a tubing hanger installed in a wellhead. The insertion tool assembly includes a lubricator comprising a rod slidably disposed therein, with the rod configured such that the BPV can be releasably attached to a distal end of the rod. The assembly also includes a tubular adapter that includes a main body with a top end and a bottom end and a central bore therethrough. The top end is detachably attached to the lubricator and the bottom end is configured to be detachably attached to the crown of the wellhead. An internal diameter of the central bore is greater than an external diameter of the BPV. The tubular adapter also includes a kill fluid port disposed through a side-wall of the main body. The method further includes extending the rod and thereby passing the BPV through the tubular adapter and into the wellhead through the crown top and, in response to a well control event indication, injecting a kill fluid into the kill fluid port, thereby flowing kill fluid through the crown top into the well.

In a ninth aspect according to the first aspect, the kill fluid flowing through the crown top into the well flows into the well through an open, top-most valve of the wellhead below the crown top.

In a tenth aspect according to the eighth or ninth aspect, when the kill fluid flows through the crown top into the well, all wellhead valves through which the rod is configured to pass when the rod is extended are open.

In an eleventh aspect according to any of the eighth aspect to the tenth aspect, the kill fluid flowing through the crown top into the well does not flow through the BPV to the crown top when the rod is in a retracted position.

In a twelfth aspect according to any of the eighth aspect to the tenth aspect, the kill fluid flowing through the crown top into the well flows through the BPV.

In a thirteenth aspect according to any of the eighth aspect to the twelfth aspect, the insertion assembly is configured such that, when the BPV is attached to the distal end and the rod fully retracted, the BPV does not extend past the bottom end.

In a fourteenth aspect according to any of the eighth aspect to the thirteenth aspect, the insertion tool assembly is configured such that injection of a fluid into the kill fluid line port from the fluid line dislodges debris within the central bore.

In a fifteenth aspect according to the fourteenth aspect, the insertion tool assembly is configured such that the injection of the fluid occurs uphole of the BPV while the BPV is fully retracted into the tubular adapter.

In a sixteenth aspect, a method includes attaching a top end of a tubular adapter to a lubricator. The lubricator includes a rod slidably disposed therein, with the rod configured such that a BPV can be releasably attached to a distal end of the rod. The tubular adapter includes a main body with a top end and a bottom end and with a central bore therethrough and a kill fluid port disposed through a side-wall of the main body. While maintaining a crown top valve of a crown top of a wellhead of a well closed and the rod fully retracted such that the BPV attached to its distal end is within the central bore and above the bottom end, the bottom end of the tubular adapter is attached to the crown top. After attaching the bottom end to the crown top, the crown top valve is opened. After opening the crown top valve, the rod is extended, thereby passing the BPV out the bottom end of the tubular adapter and into the wellhead through the crown top. After the extending, the BPV is retracted from the wellhead with the rod and into the central bore of the tubular adapter above the bottom end and the crown top valve is thereafter closed while the bottom end remains attached to the crown top.

In a seventeenth aspect according to the sixteenth aspect, in response to a well control event indication while the bottom end of the tubular adapter is attached to the crown top and the crown valve is open, injecting a kill fluid is injected into the kill fluid port, thereby flowing kill fluid through the crown top into the well In an eighteenth aspect according to the sixteenth aspect or the seventeenth aspect, a fluid comprising a surfactant into the kill fluid port is injected in response to an indication of debris on or proximate the BPV.

In a nineteenth aspect according to the eighteenth aspect, the insertion tool assembly is configured such that the injection of the fluid occurs uphole of the BPV while the BPV is fully retracted into the tubular adapter.

In a twentieth aspect according to any of the sixteenth aspect to the nineteenth aspect, the insertion assembly is configured such that, when the BPV is attached to the distal end and the rod fully retracted, the BPV does not extend past the bottom end.

What is claimed is:

1. An insertion tool assembly for disposing a back-pressure valve (BPV) in a tubing hanger installed in a wellhead of a well, the insertion tool assembly configured to isolate pressure from the well when attached to a top-most crown of the wellhead and the BPV configured to, when disposed in the tubing hanger, prevent fluid flow from the well through the wellhead while permitting fluid to be pumped into the well, the insertion tool assembly comprising:

a lubricator comprising a rod slidably disposed therein, the rod configured such that the BPV can be releasably attached to a distal end of the rod;

a tubular adapter comprising:

a main body with a top end and a bottom end and a central bore therethrough, the top end detachably attached to the lubricator and the bottom end configured to be detachably attached to the crown top of the wellhead, wherein an internal diameter of the central bore is greater than an external diameter of the BPV; and a kill fluid port disposed through a side-wall of the main body, wherein the insertion tool assembly is configured such that, when the BPV is attached to the distal end of the rod and the bottom end of the tubular adapter is attached to the crown top:

the BPV can pass through the tubular adapter and into the wellhead through the crown top as the rod is extended from the lubricator; and a kill fluid injected into the kill fluid port and uphole of the BPV while the BPV is fully retracted into the tubular adapter can flow through the crown top into the well.

2. The insertion tool assembly of claim 1, wherein the insertion tool assembly is configured such that, when a crown valve of the wellhead is open, the kill fluid flowing into the tubular adapter flows vertically through the crown top into the well through the crown valve.

3. The insertion tool assembly of claim 1, wherein the insertion tool assembly is configured such that, when kill fluid flows through the crown top into the well, all wellhead valves through which the rod can pass when extended are open.

4. The insertion tool assembly of claim 1, wherein the kill fluid flowing through the crown top into the well flows through the BPV.

5. The insertion tool assembly of claim 1, wherein the BPV, when attached to the distal end and the rod fully retracted, does not extend past the bottom end.

6. The insertion tool assembly of claim 1, wherein the insertion tool assembly is configured such that injection of a fluid into the kill fluid line port from the fluid line dislodges debris within the central bore.

7. The insertion tool assembly of claim 1, wherein the assembly is configured such that the crown top of the wellhead can remain closed as the bottom end is attached to the bottom end and can be opened after attaching the bottom end to the crown top.

8. A method comprising:

attaching, to a crown top of a wellhead of a well, an insertion tool assembly for disposing a back-pressure valve (BPV) in a tubing hanger installed in a wellhead, the insertion tool assembly comprising:

a lubricator comprising a rod slidably disposed therein, wherein the BPV is releasably attached to a distal end of the rod; and a tubular adapter comprising:

a main body with a top end and a bottom end and a central bore therethrough, the top end detachably attached to the lubricator and the bottom end configured to be detachably attached to the crown of the wellhead, wherein an internal diameter of the central bore is greater than an external diameter of the BPV; and a kill fluid port disposed through a side-wall of the main body;

extending the rod and thereby passing the BPV through the tubular adapter and into the wellhead through the crown top; and in response to a well control event indication, injecting a kill fluid into the kill fluid port, thereby flowing kill fluid through the crown top into the well, wherein the insertion tool assembly is configured such that injection of a fluid into the kill fluid line port from the fluid line dislodges debris within the central bore and injection of the fluid occurs uphole of the BPV while the BPV is fully retracted into the tubular adapter.

9. The method of claim 8, wherein the kill fluid flowing through the crown top into the well flows into the well through an open, top-most valve of the wellhead below the crown top.

10. The method of claim 8, wherein, when the kill fluid flows through the crown top into the well, all wellhead valves through which the rod is configured to pass when the rod is extended are open.

11. The method of claim 8, wherein the kill fluid flowing through the crown top into the well does not flow through the BPV to the crown top when the rod is in a retracted position.

12. The method of claim 8, wherein the kill fluid flowing through the crown top into the well flows through the BPV.

13. The method of claim 8, wherein the insertion tool assembly is configured such that, when the BPV is attached to the distal end and the rod fully retracted, the BPV does not extend past the bottom end.

14. A method comprising:

attaching a top end of a tubular adapter to a lubricator, the lubricator comprising a rod slidably disposed therein, the rod configured such that a back-pressure valve (BPV) can be releasably attached to a distal end of the rod, the tubular adapter comprising:

a main body with a top end and a bottom end and with a central bore therethrough; and a kill fluid port disposed through a side-wall of the main body;

while maintaining a crown top valve of a crown top of a wellhead of a well closed and the rod fully retracted such that the BPV attached to its distal end is within the central bore and above the bottom end, attaching the bottom end of the tubular adapter to the crown top;

after attaching the bottom end to the crown top, opening the crown top valve;

after opening the crown top valve, extending the rod and thereby passing the BPV out the bottom end of the tubular adapter and into the wellhead through the crown top;

after the extending, retracting the BPV from the wellhead with the rod and into the central bore of the tubular adapter above the bottom end and thereafter closing the crown top valve while the bottom end remains attached to the crown top; and injecting a fluid comprising a surfactant into the kill fluid port in response to an indication of debris on or proximate the BPV, wherein the insertion tool assembly is configured such that the injection of the fluid occurs uphole of the BPV while the BPV is fully retracted into the tubular adapter.

15. The method of claim 14, further comprising, in response to a well control event indication while the bottom end of the tubular adapter is attached to the crown top and the crown valve is open, injecting a kill fluid into the kill fluid port, thereby flowing kill fluid through the crown top into the well.

16. The method of claim 14, wherein, when the BPV is attached to the distal end and the rod fully retracted, the BPV does not extend past the bottom end.

* * * * *